US008899573B2

(12) United States Patent
Kamata

(10) Patent No.: US 8,899,573 B2
(45) Date of Patent: Dec. 2, 2014

(54) IMAGE FORMING APPARATUS

(71) Applicant: Yoshihisa Kamata, Kanagawa (JP)

(72) Inventor: Yoshihisa Kamata, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/762,174

(22) Filed: Feb. 7, 2013

(65) Prior Publication Data

US 2013/0214477 A1 Aug. 22, 2013

(30) Foreign Application Priority Data

Feb. 17, 2012 (JP) ..... 2012-033023

(51) Int. Cl.

| | |
|---|---|
| ***B65H 3/44*** | (2006.01) |
| ***B65H 5/26*** | (2006.01) |
| ***B65H 33/04*** | (2006.01) |
| ***B65H 39/00*** | (2006.01) |
| ***B65H 7/20*** | (2006.01) |
| ***G03G 15/00*** | (2006.01) |

(52) U.S. Cl.

CPC ..... *B65H 7/20* (2013.01); *B65H 2701/11132* (2013.01); *B65H 2551/18* (2013.01); *B65H 3/44* (2013.01); *B65H 2405/312* (2013.01); *G03G 15/6508* (2013.01); *B65H 2405/332* (2013.01); *B65H 2511/415* (2013.01); *B65H 2405/15* (2013.01); *B65H 2511/416* (2013.01); *B65H 2511/414* (2013.01); *G03G 2215/00894* (2013.01)

USPC ..... 271/9.05; 270/58.32; 270/58.23

(58) Field of Classification Search

USPC ..... 271/9.01, 9.05; 270/58.31, 58.23, 58.32

See application file for complete search history.

(56) References Cited

U.S. PATENT DOCUMENTS

| | | | | |
|---|---|---|---|---|
| 7,063,317 | B2 * | 6/2006 | Sato et al. | 271/225 |
| 7,547,010 | B2 * | 6/2009 | Yokobori et al. | 271/9.01 |
| 7,946,570 | B2 * | 5/2011 | Shinchi et al. | 271/9.02 |
| 8,100,392 | B2 * | 1/2012 | Shinchi et al. | 270/58.31 |
| 8,139,259 | B2 * | 3/2012 | Shinchi et al. | 358/1.18 |
| 8,152,154 | B2 * | 4/2012 | Nakagawa et al. | 270/58.32 |
| 2010/0019436 | A1 * | 1/2010 | Nakagawa et al. | 270/58.32 |
| 2011/0036256 | A1 | 2/2011 | Sakuraba | |
| 2011/0266740 | A1 * | 11/2011 | Nakagawa et al. | 270/58.32 |

FOREIGN PATENT DOCUMENTS

| | | | |
|---|---|---|---|
| JP | 09-258615 | A | 10/1997 |
| JP | 2008-023831 | A | 2/2008 |
| JP | 2008-023833 | A | 2/2008 |
| JP | 2011-039780 | A | 2/2011 |

OTHER PUBLICATIONS

Japanese Office Action dated Jan. 29, 2014 (and English translation thereof) in counterpart Japanese Application No. 2012-033023.

* cited by examiner

*Primary Examiner* — David H Bollinger

(74) *Attorney, Agent, or Firm* — Holtz, Holtz, Goodman & Chick PC

(57) ABSTRACT

An image forming apparatus has a plurality of trays to store an index sheet provided with a tab at a predetermined position of the index sheet, a setting section to set first information concerning the index sheet stored in the tray for each of the plurality of trays, a receiving section to receive second information concerning an insertion of the index sheet in a job, and a controller to control an execution of the job and an operation of feeding the index sheet. The controller automatically selects the tray in the execution of the job based on the first information and the second information.

7 Claims, 19 Drawing Sheets

EXAMPLE OF CASE WHERE TAB POSITION "2" IS DESIGNATED

EXAMPLE OF CASE WHERE TAB POSITION "BUNDLE" IS DESIGNATED

FIG.14

1. GROUP DESIGNATION SETTING

0 : NO DESIGNATION
1 : GROUP 1
2 : GROUP 2
3 : GROUP 3
4 : GROUP 4
5 : GROUP 5

2. SETTING OF NUMBER OF INDEXES 0-10 : NUMBER OF INDEXES

3. TAB POSITION SETTING

0 : BUNDLE
1-10 : TAB POSITION

4. NUMBER OF USED TRAYS 1-8 : NUMBER OF USED TRAYS

5. USE ORDER TRAY INFORMATION

| |
|---|
| INSERTING TRAY 1 |
| INSERTING TRAY 2 |
| INSERTING TRAY 3 |
| INSERTING TRAY 4 |
| INSERTING TRAY 5 |
| INSERTING TRAY 6 |
| INSERTING TRAY 7 |
| INSERTING TRAY 8 |

← STORE TRAY No. OF TRAY THAT IS USED SEQUENTIALLY FROM TOP

1 : TRAY 1 2 : TRAY 2
3 : TRAY 3 4 : TRAY 4
5 : TRAY 5 6 : TRAY 6
7 : TRAY 7 8 : TRAY 8

6. INSERTION COUNTER 1-8 : POINTER OF REFERENCE OF USE ORDER TRAY INFORMATION
WHEN INSERTION COUNTER IS "0", IT REPRESENTS INSERTING TRAY 1 OF USE ORDER TRAY INFORMATION

IMAGE FORMING APPARATUS

CROSS-REFERENCE TO RELATED APPLICATION

This application is based on Japanese Patent Application No. 2012-033023 filed with Japan Patent Office on Feb. 17, 2012, the entire content of which is hereby incorporated by reference.

TECHNICAL FIELD

An embodiment of the present invention relates to an image forming apparatus capable of inserting an index sheet having a tab between sheets and outputting the sheets.

DESCRIPTION OF RELATED ART

In recent years, many image forming apparatuses have a function of inserting an index sheet provided with a tab between sheets in a case where images are formed on a set of sheets (for example, Japanese Patent Application Laid-Open No. 2008-23833). In such image forming apparatuses, a plurality of index sheets having tabs at mutually different positions are set as one set, and a plurality of sets of index sheets are housed in a sheet feed tray. Then, the index sheets are fed in the housing order and are inserted between sheets on which images are formed.

For example, in order to constantly insert an index sheet having a tab at a specific position first, a plurality of sets of index sheets are loaded in advance such that an index sheet having a tab at the specific position is arranged at an uppermost position in one set.

However, in conventional image forming apparatuses, in the insertion of index sheets, there are problems as below.

In a case where there are remaining index sheets being not used, the remaining index sheets need to be discharged, and a time is required for the discharging process.

In a case where a jam occurs in the middle of the execution of a job, index sheets that remain in the sheet feed tray are useless.

When index sheets are inserted, the index sheets need to be inserted only in order in which the index sheets are loaded in the sheet feed tray.

When index sheets are inserted, a sheet feed tray in which an index sheet to be inserted needs to be designated for each insertion position, and it takes time for the setting thereof.

In the image forming apparatus disclosed in Japanese Patent Application Laid-Open No. 2008-23833 described above, by reversing unnecessary index sheets inside the body, effective use is achieved, and uselessness of the index sheets is prevented. However, the problem of the uselessness of the index sheets is not sufficiently solved, and the other problems described above are not solved.

SUMMARY

In general, in one aspect, the present invention relates to an image forming apparatus wherein an index sheet is inserted between sheets. The image forming apparatus comprises a plurality of trays to store an index sheet provided with a tab at a predetermined position of the index sheet; a setting section to set first information concerning the index sheet stored in the tray for each of the plurality of trays; a receiving section to receive second information concerning an insertion of the index sheet in a job; a controller to control an execution of the job and an operation of feeding the index sheet; wherein the controller automatically selects the tray in the execution of the job based on the first information and the second information.

It is preferable in the above image forming apparatus that the first information includes a tab position of the index sheet stored in the tray, the second information includes an inserting position of inserting the index sheet and the tab position of the index sheet used in the job, and the controller selects the tray which stores the index sheet provided with the tab at the tab position of the index sheet used in the job when the index sheet is inserted.

It is preferable in the above image forming apparatus that the first information includes a tab position of the index sheet stored in the tray and an index number which shows the number of types of the tab position of the index sheet, the second information includes an inserting position of inserting the index sheet, the controller selects the tray which stores the index sheet provided with the tab at the tab position of the index sheet used in the job based on the index number when the index sheet is inserted.

It is preferable in the above image forming apparatus that the first information includes a group of a plurality of the index sheets stored in the tray and grouped according to the tab position.

It is preferable in the above image forming apparatus that the second information includes a group of a plurality of the index sheets used in the job and grouped according to the tab position.

It is preferable in the above image forming apparatus that the controller enables to carry out a manual inserting mode which enables to select the tray for inserting the index sheet manually.

It is preferable that the above image forming apparatus further includes an input section which is enable to be operated by a user and controlled by the controller.

It is preferable in the above image forming apparatus that the second information is set by the input section.

It is preferable in the above image forming apparatus that the setting section sets the first information base on information inputted by the input section.

It is preferable that the above image forming apparatus further includes a memory controlled by the controller, wherein the controller writes the first information on the memory.

It is preferable in the above image forming apparatus that the first information includes an information that a series of the index sheets are stored in the tray.

BRIEF DESCRIPTION OF DRAWINGS

FIG. 14 is a diagram that illustrates the data structure used for the control of insertion of index sheets in the image forming apparatus according to the embodiment of the present invention.

DETAILED DESCRIPTION OF THE PREFERRED EMBODIMENTS

Figure 1:
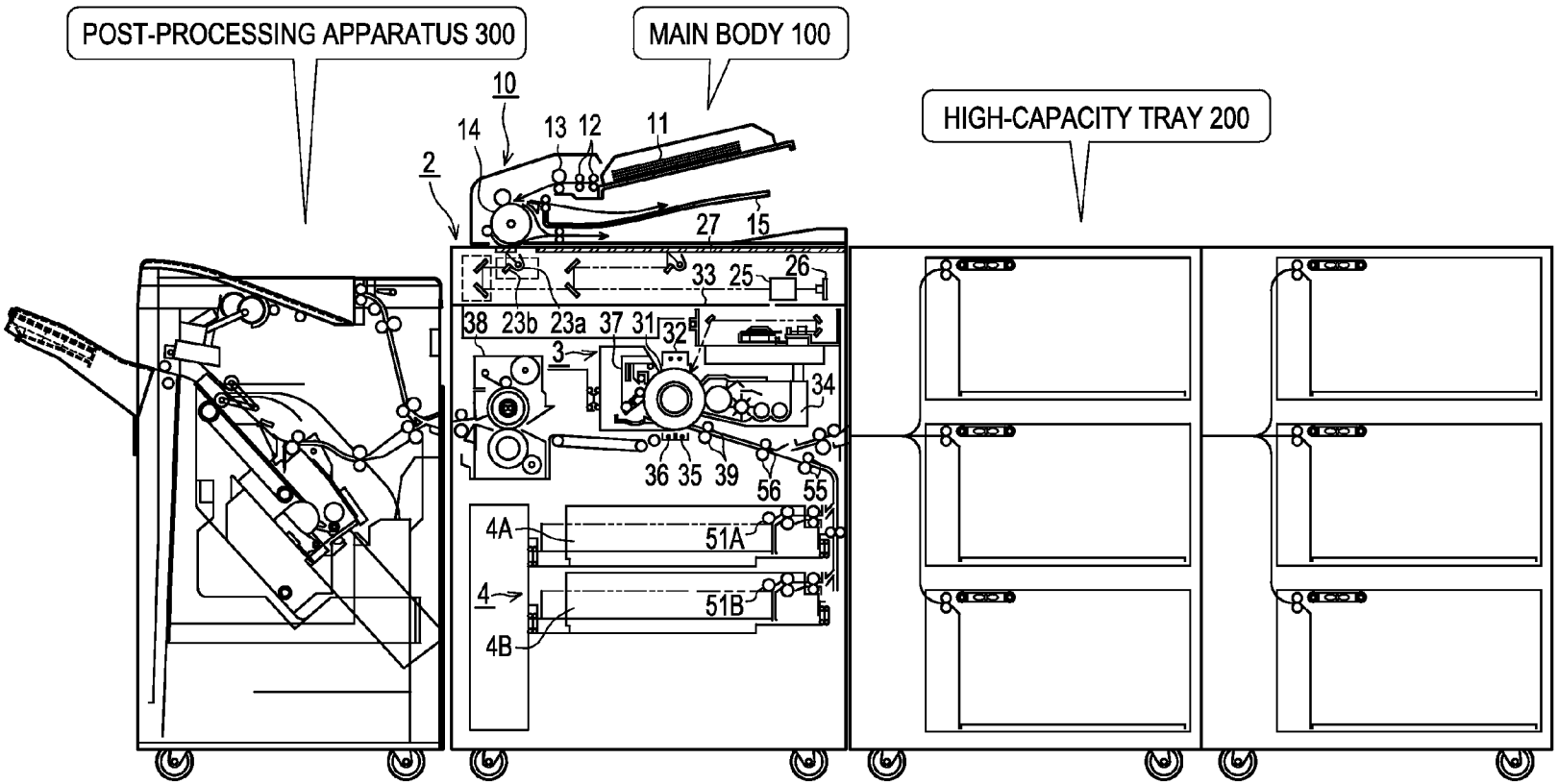
FIG. 1 is a schematic diagram that illustrates the mechanical configuration of an image forming apparatus according to an embodiment of the present invention.

Hereinbelow, typical embodiments of the present invention will be explained with reference to the drawings. FIG. 1 is a configuration diagram of an image forming apparatus. The image forming apparatus includes a main body 100, a high-capacity tray 200, and a post-processing apparatus 300.

First, the main body 100 will be described.

Documents are placed in a document feeding stand 11 of an automatic document conveying unit 10 as automatic document conveying means with image faces turned upward and are send out one by one by the operation of send-out rollers 12. Then, the document is stopped once by a resistance roller 13, has the front end being arranged, and is conveyed to a conveying drum 14. In the process of rotating the document along the drum face in the counterclockwise direction, the image face of the document is read by an image reading unit 2 as image reading means. Thereafter, at a position at which the conveying drum 14 is rotated by an approximately half turn, the document is separated from the drum face and is discharged to a sheet discharging stand 15. In addition, the automatic document conveying unit 10 also has a conveying function for double-sided reading in addition to the conveying function for single-sided reading described above, description of the operation thereof will not be presented.

The image reading unit 2 has a first mirror unit that includes a light source 23*a* and a mirror 23*b* and a second mirror unit that includes a mirror arranged so as to be perpendicular to the movement direction of a document. The first mirror unit sequentially illuminates passing documents at a position right below the conveying drum 14. The second mirror unit forms an image using reflected light reflected from the document on an imaging device 26 having a linear shape through an imaging lens 25. The image reading unit 2 also has a function of reading a document image placed on a stop document stand 27 by moving the first mirror unit and the second mirror unit.

Image processing is performed for image information of the document image read by the image reading unit 2 by image processing means that is not illustrated in the figure. The image information for which the image processing has been performed is stored in a memory.

When an image forming unit 3 as image forming means using an electro-photographic process operates, the image information is read from the memory and is input to an image writing unit 33. Then, a laser beam that is modulated in accordance with the image information is emitted from a laser emitter not illustrated in the figure. The emitted laser beam is reflected in accordance with the rotation operation of a polygon mirror and exposes the surface of a photoreceptor drum 31 as an image carrier. The photoreceptor drum 31 is applied with a charging electric potential by an electric charger 32 in advance. By exposing the surface of the photoreceptor drum 31 with which the charging electric potential is applied, an electrostatic latent image according to the image information is formed on a photosensitive layer. The electrostatic latent image is developed in an inverted manner by a developer 34, thereby becoming a toner image.

Meanwhile, a sheet is fed from a sheet feeding tray 4 that houses sheets. For example, the sheet feeding tray 4 has two stages 4A and 4B. Any one of sheet feed rollers 51A and 51B operates so as to carry out a sheet, and the sheet is fed by conveying rollers 55 and 56 and a timing roller 39 and is conveyed in synchronization with a toner image formed on the photoreceptor drum 31.

The transfer unit 35 applies a voltage having a polarity opposite to the polarity of the toner, whereby the toner image formed on the photoreceptor drum 31 is transferred to the recording sheet side. The electricity of the recording sheet to which the toner image is transferred is eliminated by a static eliminator 36, and the recording sheet is separated from the photoreceptor drum 31 and is conveyed to a fixing unit 38 as fixing means by a conveying belt. The toner image is fixed by pressing and heating of a pair of heating rollers in the fixing unit 38. A sheet on which the toner image is fixed is discharged and is conveyed to the post-processing apparatus 300.

After a remaining electric potential is eliminated from the photoreceptor drum 31 from which the sheet is separated, a cleaning process for eliminating remaining toner is performed for the photoreceptor drum 31 by a cleaning device 37.

The high-capacity tray 200, for example, has sheet feeding trays of two rows and three stages, and a sheet housed in any one of the sheet feeding trays is conveyed to the inside of the main body 100 and arrives at the conveying roller 56, and the conveying process and the image forming process are performed for the sheet as described above.

In some or all of the sheet feeding tray 4 and the high-capacity tray 200, the index sheets can be housed.

The post-processing apparatus 300 is an apparatus that performs post-processing for a sheet for which image formation has been performed by the main body 100. In the post-processing performed by the post-processing apparatus 300, one or a plurality of processes out of various processes such as a punching process, a folding process, and a binding process are included.

In this example, the post-processing apparatus 300 is formed by a binder that binds sheets. The detailed configuration of the post-processing apparatus 300 will not be presented.

In this embodiment, while a case has been described in which the image forming apparatus is configured by connecting the high-capacity tray 200 and the post-processing apparatus 300 to the main body 100, apparatuses that are connected to the main body 100 are not limited thereto. In addition, the image forming apparatus may be configured by only the main body.

Figure 2:
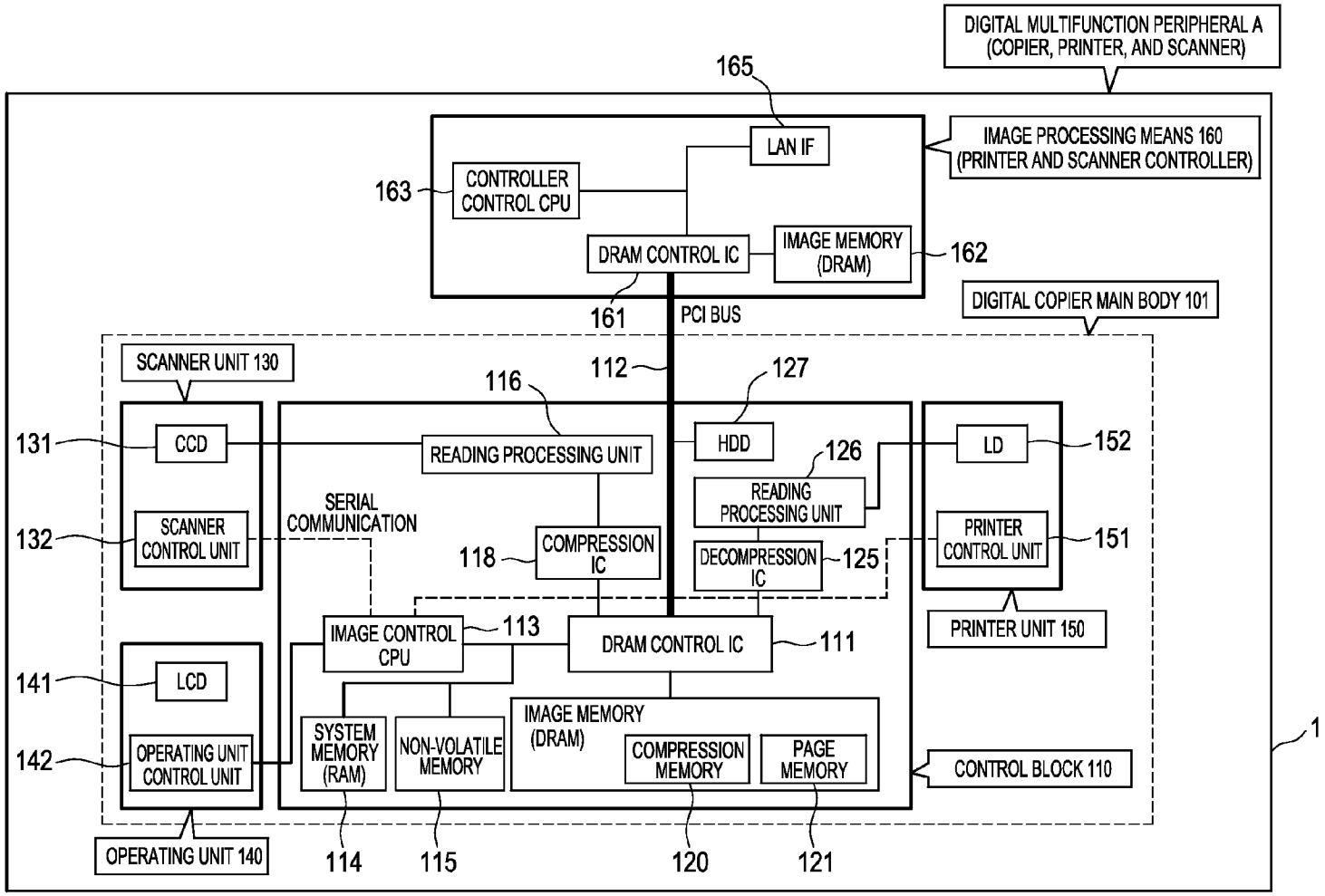
FIG. 2 is a circuit block diagram of the image forming apparatus according to the embodiment of the present invention.

Next, FIG. 2 is diagram that illustrates circuit blocks of an image forming apparatus that serves as a digital multifunction peripheral A (a copier, a printer, and a scanner) and the circuit blocks will be described below in detail.

The image forming apparatus includes a digital copier main body 101 and image processing means 160. The digital copier main body 101 includes a control block 110, a scanner unit 130, an operating unit 140, and a printer unit 150. The image processing means 160 processes image data that is input from an external device such as a terminal (personal computer) through a LAN not illustrated in the figure. In addition, the image processing means 160 transmits image data acquired by the scanner unit 130 to an external device such as a terminal (personal computer) through the LAN.

The control block 110 includes a PCI bus 112 that is connected to the image processing means 160, and a DRAM control IC 111 is connected to the PCI bus 112. An image memory that is formed by a compression memory 120 and a page memory 121 is connected to the DRAM control IC 111. The compression memory 120 is a memory that is used for storing compressed image data of a document image or the like, and the page memory 121 is a memory that is used for temporarily storing non-compressed image data that is a printing target before the formation of an image.

In addition, an HDD 127 that is connected to the PCI bus 112 stores information of a job that is generated by the image forming apparatus 1, the terminal (personal computer) that is connected to the image processing means 160, or the like. In the HDD 127, a plurality of jobs can be stored. In the information of each job, image data is included, and, in a case where index sheets are inserted, index sheet inserting information is included therein.

The control block 110 includes an image control CPU 113, and the DRAM control IC 111 is connected to the image control CPU 113.

In addition, a system memory (RAM) 114 and a non-volatile memory 115 are connected to the image control CPU 113. In the non-volatile memory 115, initial print setting information of the image forming apparatus 1, mechanical setting information such as process control parameters, user setting values, setting data of sheet information (a sheet size, a sheet type, and the like) of each sheet feeding tray, management information of a reserved job, a program for operating the image control CPU 113, and the like are stored so as to be readable and writable. The system memory (RAM) 114 is used as a temporary storage area of data and the like.

The image control CPU 113 can read data that is stored in the non-volatile memory 115 and can write desired data into the non-volatile memory 115. The image control CPU 113 controls the operation of each unit of the image forming apparatus 1 based on the mechanical setting information, the print setting information, the job information, and the like.

The image control CPU 113 controls the overall operation of the image forming apparatus 1. In addition, the image control CPU 113 controls a reservation of a job that is stored in the HDD 127 or the compression memory 120, the execution of the job, and the like.

In the system memory (RAM) 114, the non-volatile memory 115, the HDD 127, and the like, as described above, the data relating to a job, the setting data of a sheet feeding tray, and the like are stored.

A scanner unit 130 includes a CCD 131 that performs optical reading and a scanner control unit 132 that controls the overall operation of the scanner unit 130. The scanner control unit 132 and the image control CPU 113 are connected to each other so as to enable serial communication therebetween. The CCD 131 is connected to a reading processing unit 116 that processes the image data read by the CCD 131. A compression IC 118 that performs a compressing process of the image data is connected to the reading processing unit 116. The compression IC 118 is connected to the DRAM control IC 111 described above.

The operating unit 140 has both a function of displaying information and a function of receiving a user's operation. The operating unit 140 includes an LCD 141 that is configured by a touch panel and an operating unit control unit 142 that controls the overall operation of the operating unit 140. The operating unit control unit 142 and the image control CPU 113 are connected to each other so as to enable serial communication therebetween. The operating unit 140 can perform print setting, settings relating to input, output, and the like of mechanical settings such as operating control conditions, setting of sheet information (the size, the sheet type, and settings relating to an index sheet) of each sheet feeding tray, an output mode, and the like in the image forming apparatus 1 by using the LCD 141 under the control of the image control CPU 113. In the output mode, an automatic index sheet inserting mode and a manual index sheet inserting mode are included in a case where index sheets are used.

In addition, the operating unit 140 can perform display of the contents of the settings, display of desired information such as a list of reserved jobs, and the like.

A decompression IC 125 that decompresses compressed image data is connected to the DRAM control IC 111. A writing processing unit 126 is connected to the decompression IC 125. The writing processing unit 126 is connected to an LD unit 152 (laser diode) of the printer unit 150 and processes writing data that is used for the operation of the LD unit 152. The LD unit 152 is included in the writing unit 34 illustrated in FIG. 1. In addition, the printer unit 150 includes a printer control unit 151 that controls the overall operation (sheet feeding, image formation, sheet discharging, post-processing, and the like) of the printer unit 150. The printer control unit 151 is connected to the image control CPU 113 described above. The printer control unit 151 controls the printer unit 150 by operating in accordance with a control instruction made by the image control CPU 113.

In addition, a DRAM control IC 161 of the image processing means 160 is connected to the PCI bus 112 to which the DRAM control IC 111 is connected. In a case where the image forming apparatus is used as a network printer or a network scanner, the image processing means 160 receives image data or the like using the image forming apparatus 1 from a terminal (personal computer) or the like that is connected to a LAN or transmits the image data acquired by the scanner unit 130 to a terminal (personal computer) or the like that is connected to the LAN. In the image processing means 160, an image memory 162 that is configured by a DRAM or the like is connected to the DRAM control IC 161. In addition, in the image processing means 160, the DRAM control IC 161, a controller control CPU 163 that controls the overall operation of the image processing means 160, and a LAN interface 165 are connected to a common bus. The LAN interface 165 is connected to a LAN not illustrated in the figure.

Next, the basic operation of the image forming apparatus 1 will be described.

First, the sequence for accumulating image data in the image forming apparatus 1 will be described.

First, in the image forming apparatus 1, a case will be described in which image data is generated by reading an image using the scanner unit 130. The scanner unit 130 optically reads an image from a document using the CCD 131. At this time, the operation of the CCD 131 is controlled by the scanner control unit 132 that receives an instruction from the image control CPU 113. The reading of a document may be performed by an automatic document feeder (ADF) or may be performed with the document being placed on a platen glass.

The image control CPU 113 operates in accordance with a program and issues an instruction to the scanner unit 130 based on an operation using the operating unit 140. Image processing is performed for the image read by the CCD 131 using the reading processing unit 116. The image data for which the image processing has been performed is compressed using a predetermined method by the compression IC 118 and is stored in the compression memory 120 through the DRAM control IC 111. In a case where the HDD 127 is used, the image data that is stored in the compression memory 120 through the DRAM control IC 111 is stored in the HDD 127.

Image data other than the image data that is read by the CCD 131 is input to the image forming apparatus 1 through the LAN. For example, image data that is generated by an application program or the like of a terminal (personal computer) or the like or image data that is generated by another image forming apparatus is input to the image forming apparatus 1 through the LAN. In such a case, the image data is received by the image processing means 160 through the LAN and the LAN interface 165. The received image data is temporarily stored in the image memory 162 by the DRAM control IC 161. The image data that is stored in the image memory 162 is transferred to the DRAM control IC 111 through the PCI bus 112 and is stored in the page memory 121. The image data that is stored in the page memory 121 is sequentially sent to the compression IC 118 through the DRAM control IC 111, is compressed, and is stored in the compression memory 120 through the DRAM control IC 111.

In a case where the image data is to be stored in the HDD 127, the image data that is stored in the compression memory 120 through the DRAM control IC 111 is stored in the HDD 127.

Together with the storing of the image data in the compression memory 120 or the HDD 127, a job setting of an output condition or the like can be performed by the operating unit 140. A plurality of reserved jobs are managed by the image control CPU 113, and job management information is stored in a storage unit such as the non-volatile memory 115.

In a case where an image is output by the image forming apparatus 1, the image data that is stored in the compression memory 120 is transmitted to the decompression IC 125 through the DRAM control IC 111 based on the job management information. The decompression IC 125 decompresses the image data. In a case where the image data stored in the HDD 127 is output as an image, the image data is temporarily stored in the compression memory 120 through the DRAM control IC 111 and is sent out to the decompression IC 125 through the DRAM control IC 111.

The decompressed image data is sent out to the writing processing unit 126 through the DRAM control IC 111. Based on data that is sent out to the writing processing unit 126, the LD unit 152 performs writing for the photoreceptor drum 31. In addition, in the printer unit 150, the printer control unit 151 that has received an instruction from the image control CPU 113 controls units such as the sheet feeding tray 4, the high-capacity tray 200, a conveying path, and the like. In the printer unit 150, formation of an image, transfer of the image to a sheet, fixing, conveying the sheet to the post-processing apparatus 300 through a conveying path, post-processing using the post-processing apparatus 300, and the like are sequentially performed, whereby printing and outputting are performed.

Figure 3:
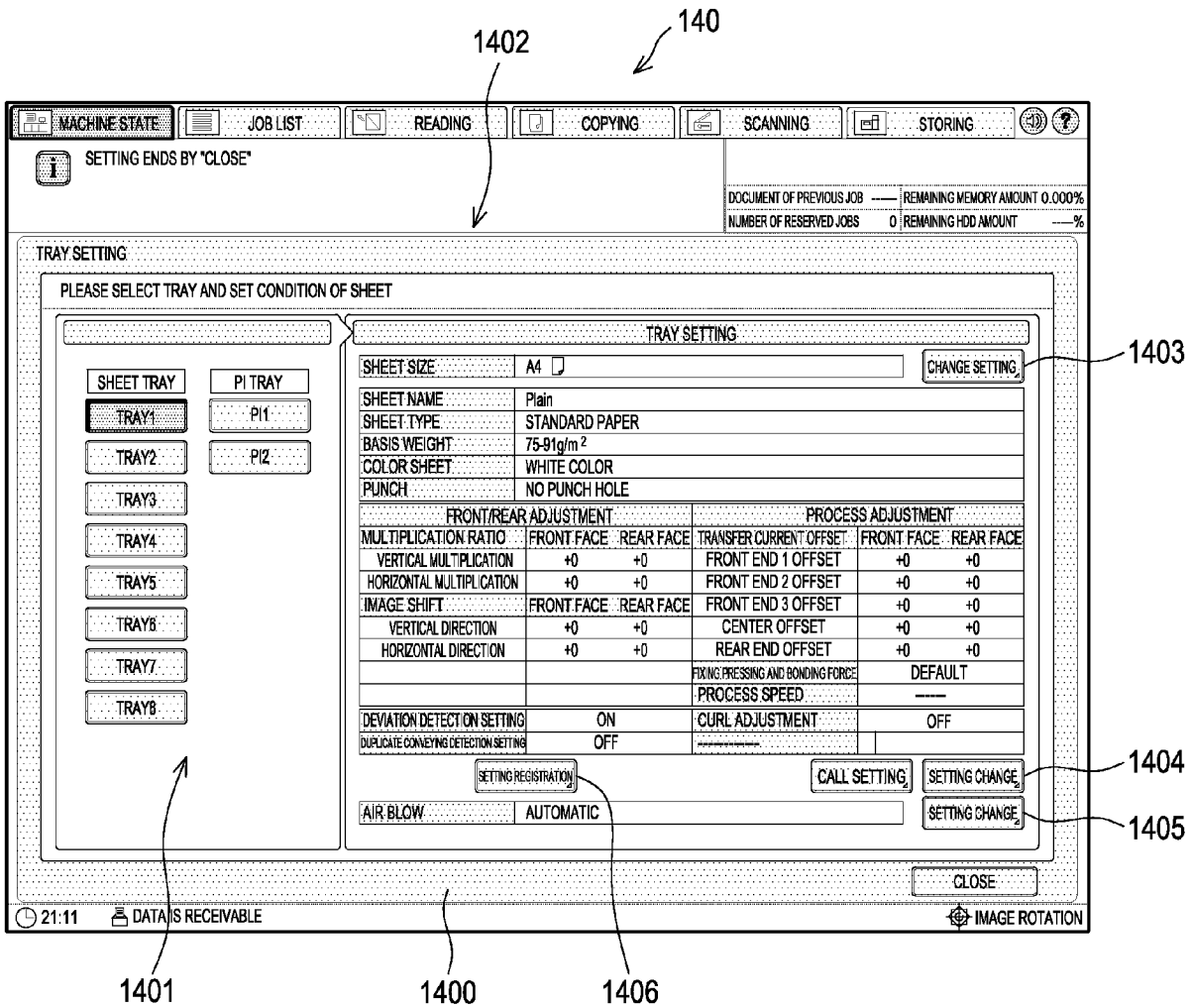
FIG. 3 is a diagram that illustrates a tray setting screen of the image forming apparatus according to the embodiment of the present invention.

Next, a tray setting screen 1400 for setting each sheet feeding tray through the operating unit 140 is illustrated in FIG. 3. The operation (display or the like) of the operating unit 140, as described above, is controlled by the image control CPU 113. The tray setting screen 1400 can be displayed by being selected on the mechanical setting screen of the image forming apparatus or the like.

On the left field side of the tray setting screen 1400, a sheet feeding tray designating button group 1401 is included. In the sheet feeding tray designating button group 1401, a plurality of buttons corresponding to each sheet feeding tray are displayed. A PI tray is a sheet inserting tray that is included in the post-processing apparatus. Namely, the sheet feeding tray may be disposed inside the main body 100 or, besides on the upstream side of the main body 100, on the downstream side of the main body 100.

In addition, on the right field side of the tray setting screen 1400, a tray setting content display field 1402 is disposed. In the tray setting content display field 1402, the contents of settings such as a sheet size, a sheet type, a front/rear adjustment, process adjustment, and air blow are displayed. In the tray setting content display field 1402, a sheet size setting change button 1403, a front/rear adjustment and process adjustment setting change button 1404, and an air blow setting change button 1405 are displayed. By pressing the setting registration button 1406, changed contents of settings are reflected and are stored in the non-volatile memory 115, the HDD 127, or the like that corresponds to a storage unit according to an embodiment of the present invention.

Figure 4:
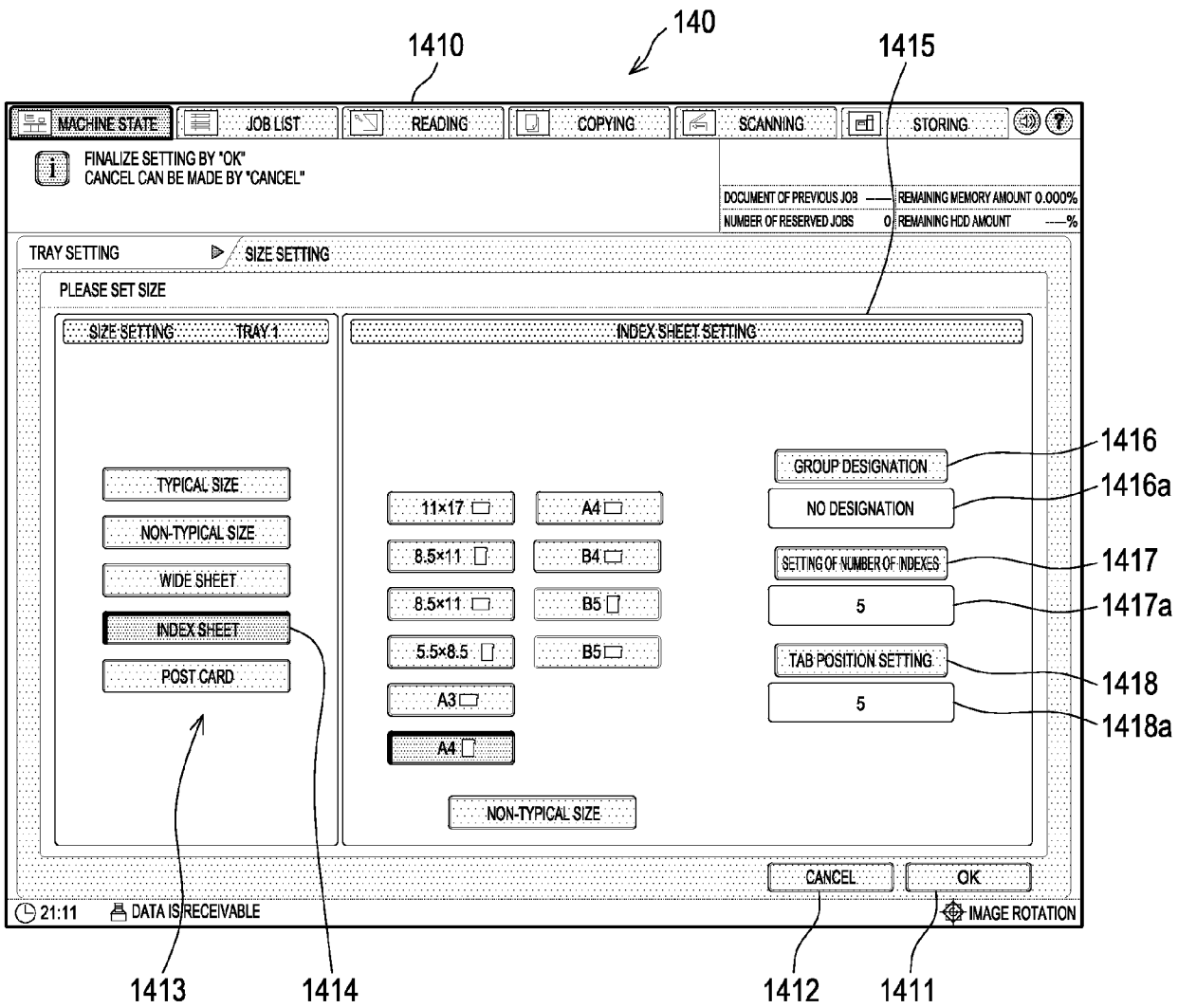
FIG. 4 is a diagram that illustrates an index sheet setting screen of the image forming apparatus according to the embodiment of the present invention.

FIG. 4 illustrates a size setting screen 1410 that is displayed on the operating unit 140 by pressing a tray-1 button included in the sheet feeding tray designating button group 1401 of the tray setting screen 1400 and further pressing the setting change button 1403. On the left field side of the size setting screen 1410, a size type setting button group 1413 is displayed for each size. In the group, an index sheet button 1414 that is used for designating an index sheet is displayed. When the index sheet button 1414 is pressed, on the right field side of the size setting screen 1410, an index sheet setting screen 1415 is displayed. On the center and the left field side of the index sheet setting screen 1415, size buttons for various sheet sizes are displayed. On the right field side thereof, a group designation setting button 1416, a group designation displaying field 1416*a*, an index number setting button 1417, a displaying field 1417*a* of the number of indexes, a tab position setting button 1418, and a tab position displaying field 1418*a* are sequentially displayed from the top to the lower side.

In addition, in the lower right field of the size setting screen 1410, an OK button 1411 and a cancel button 1412 are displayed. When the OK button 1411 is pressed, the content of the setting set on the screen is determined. On the other hand, when the cancel button 1412 is pressed, the content of the setting is cancelled.

When the group designation setting button 1416 is pressed, the right side of the screen transits to a group designation setting screen to be described later, and a content that is set on the group designation setting screen is displayed in the group designation displaying field 1416*a*. When the index number setting button 1417 is pressed, the right side of the screen transits to an index number setting screen to be described below, and a content that is set on the index setting screen is displayed on the displaying field 1417*a* of the number of indexes. When the tab position setting button 1418 is pressed, the right side of the screen transits to a tab position setting screen to be described later, and a content that is set on the tab position setting screen is displayed on the tab position displaying field 1418*a*.

Figure 5:
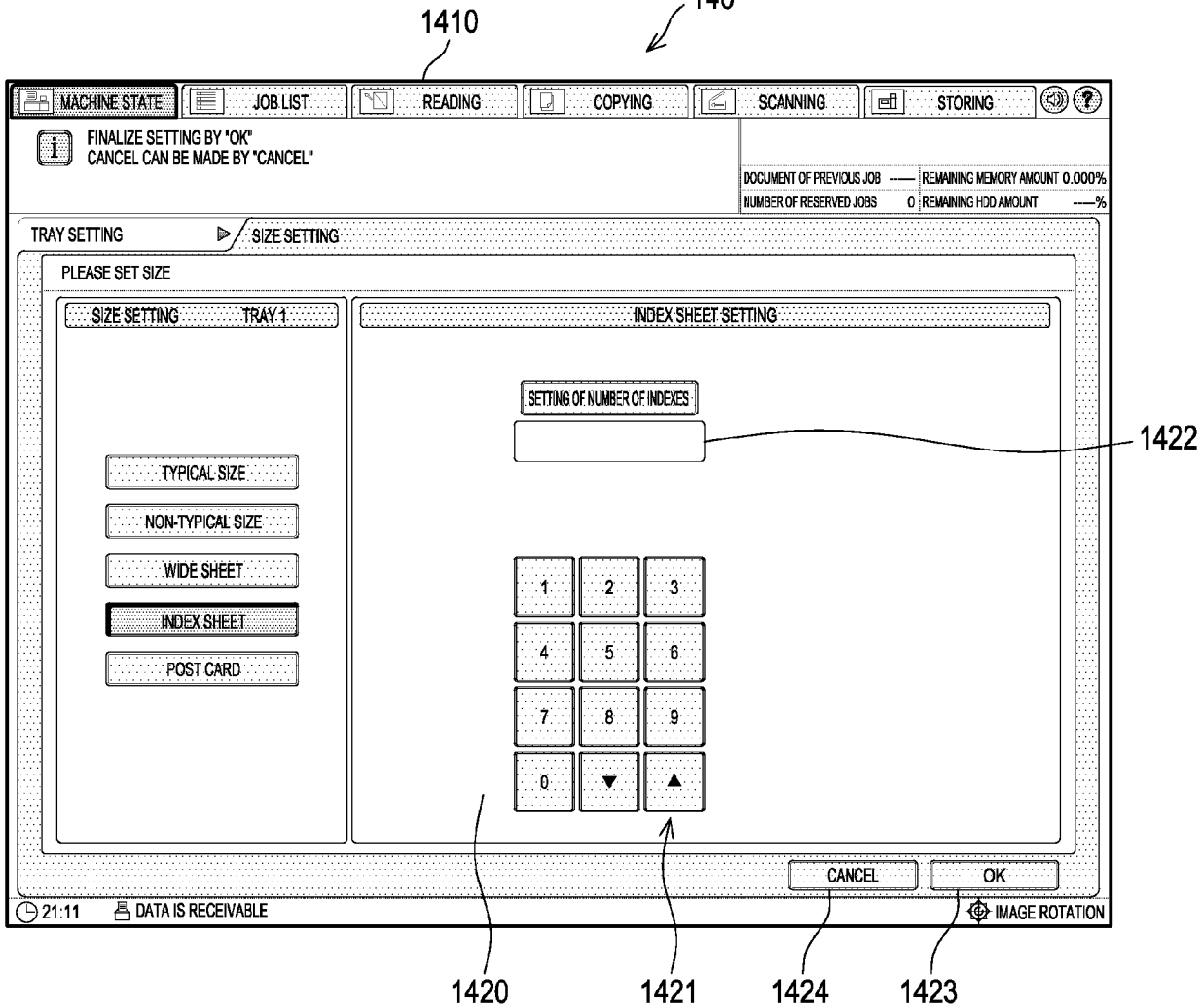
FIG. 5 is a diagram that illustrates an index number setting screen of the image forming apparatus according to the embodiment of the present invention.

FIG. 5 illustrates the size setting screen 1410 that is displayed when the index number setting button 1417 is pressed on the size setting screen 1410 illustrated in FIG. 4. On the right field side of the size setting screen 1410, an index number setting screen 1420 is displayed.

On the index number setting screen 1420, numeric keys 1421 that are used for inputting the number of indexes are displayed. By pressing the numeric keys 1421, an input numeric value is displayed in an index number inputting and displaying field 1422. By inputting the number of indexes and pressing the OK button 1423 located on the lower side of the screen, an input numeric value becomes the number of indexes. When the OK button 1423 is pressed, the screen is returned to the screen illustrated in FIG. 4, and the input numeric value is displayed in the displaying field 1417*a* of the number of indexes. On the other hand, when the cancel button 1424 located on the lower side of the screen is pressed, the numeric value that is input using the numeric keys 1421 is cancelled, the numeric value displayed in the index number inputting and displaying field 1422 is removed, and a new numeric value can be input.

Figure 6:
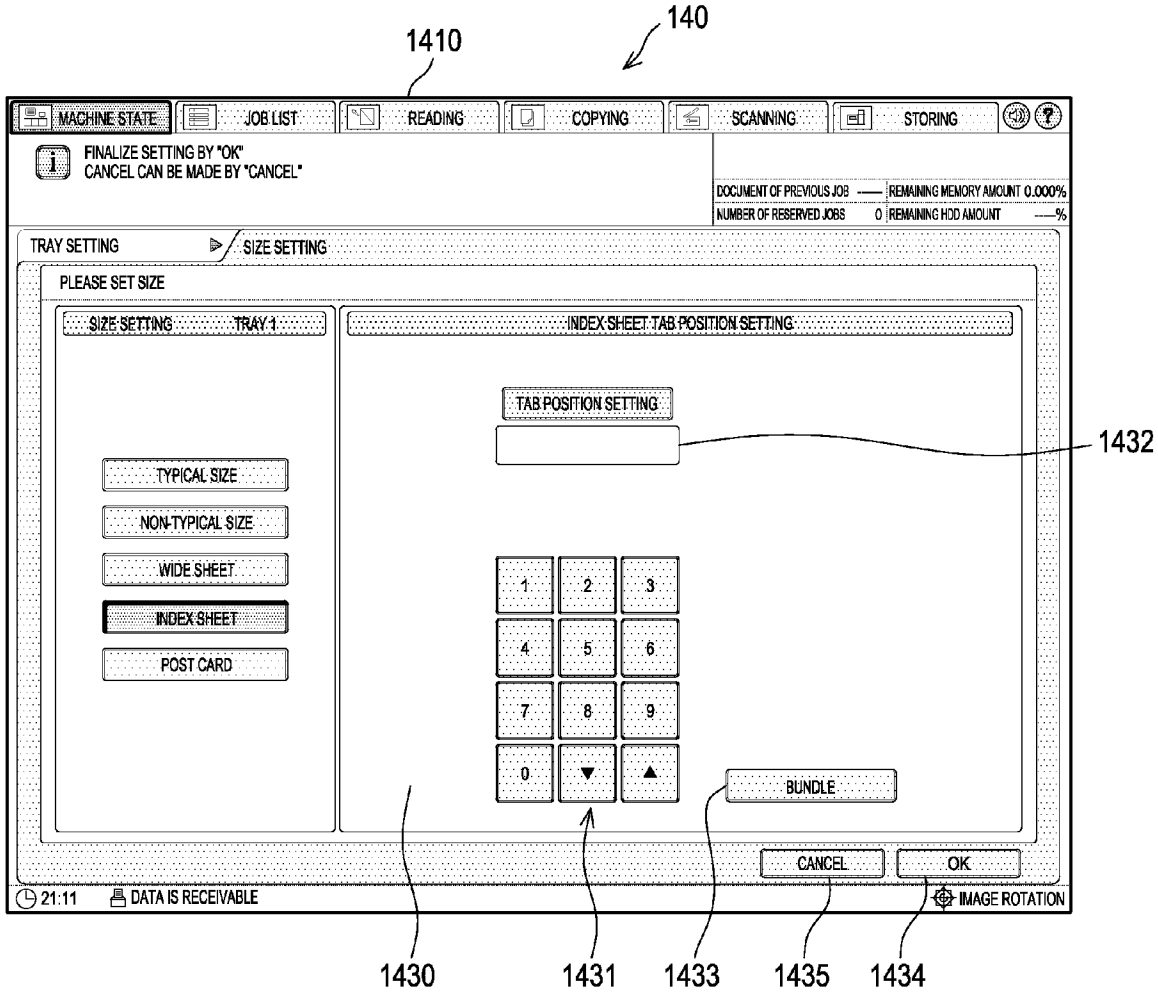
FIG. 6 is a diagram that illustrates a tab position setting screen of the image forming apparatus according to the embodiment of the present invention.

FIG. 6 illustrates the size setting screen 1410 that is displayed when the tab position setting button 1418 is pressed on the size setting screen 1410 illustrated in FIG. 4. On a right field side of the size setting screen 1410, a tab position setting screen 1430 is displayed.

On the tab position setting screen 1430, numeric keys 1431 that are used for inputting a tab position are displayed. By pressing the numeric keys 1431, an input numeric value is displayed in a tab position inputting and displaying field 1432.

On the right side of the numeric keys 1431, a bundle button 1433 is displayed. When the bundle button 1433 is pressed, index sheets corresponding to a number that is represented by the number of indexes are set to be housed in corresponding trays such that tab positions are sequentially different from one another.

Figure 7A:
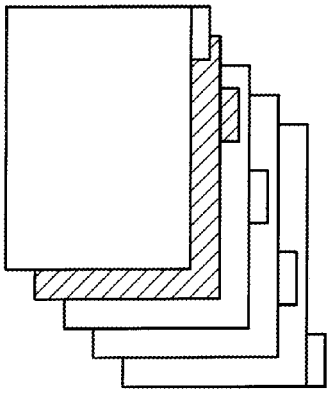
FIGS. 7A and 7B are diagrams that illustrate an example of the setting of tab positions according to the embodiment of the present invention.

FIG. 7A schematically illustrates a case where the number of indexes is five, and a tab position of "2" is designated. FIG. 7A represents that an index sheet having a tab located at a second position from the top out of five types of index sheets is housed in a tray.

Figure 7B:
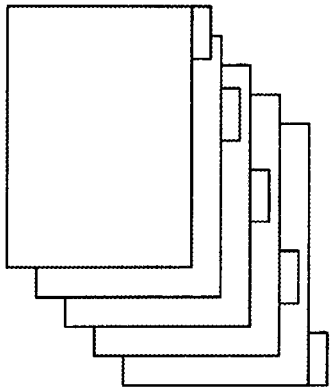

FIG. 7B represents that the number of indexes is five, and index sheets are housed in a tray by being bundled in order of tab positions. In this case, five types of index sheets are housed in the tray in order represented in the figure.

When an OK button 1434 located on the lower side of the screen is pressed in the state in which the tab position is input, the screen is returned to the screen illustrated in FIG. 4, the input numeric value is displayed in the tab position displaying field 1418*a*.

When the OK button 1434 is pressed in a state in which the bundle button 1433 is pressed, the screen is returned to the screen illustrated in FIG. 4, a representation of a bundle is displayed in the tab position displaying field 1418*a*, and a numeric value of one of one to five or the like is further displayed in accordance with the number of indexes.

When a cancel button 1435 located on the lower side of the screen is pressed, the input numeric value and the designation of a bundle are cancelled, the display represented in the tab position inputting and displaying field 1432 is removed, and an input of a new value or new designation of a bundle can be made.

Figure 8:
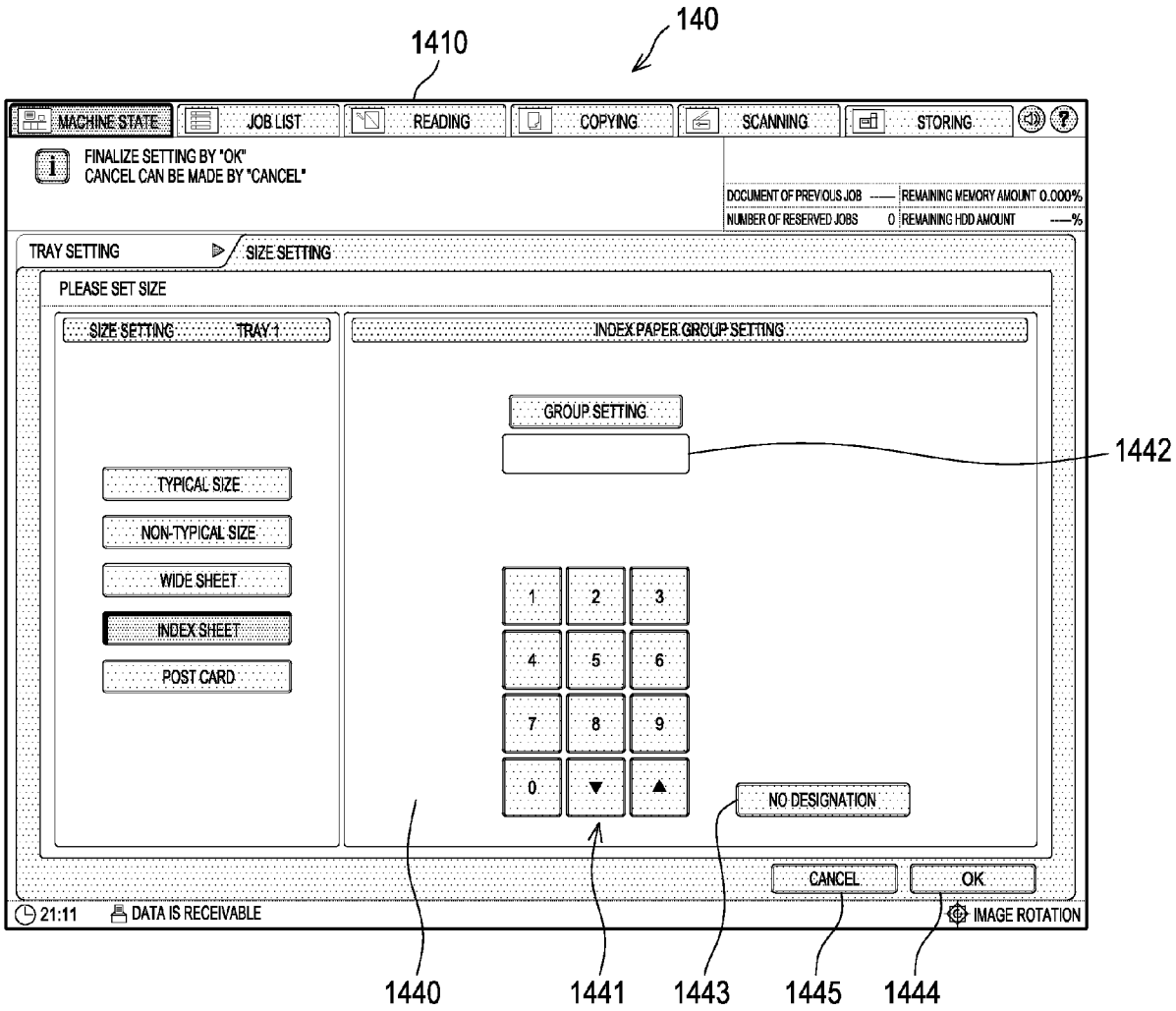
FIG. 8 is a diagram that illustrates a group setting screen of the image forming apparatus according to the embodiment of the present invention.

FIG. 8 illustrates a size setting screen 1410 that is displayed when the group designation setting button 1416 is pressed on the size setting screen 1410 illustrated in FIG. 4. On the right field side of the size setting screen 1410, a group setting screen 1440 is displayed.

The group setting screen 1440 is used for designating a group to which an index sheet loaded in the tray belongs. For example, in a case where index sheets of two types are loaded in a plurality of sheet feeding trays, a group setting is performed so as to determine a sheet feeding tray from which an index sheet is inserted. The group is a group of index sheets according to the tab positions. In this embodiment, the group represents a set of index sheets having tabs at mutually different positions.

For example, in a case where index sheets (index sheets A and B) of two types having tabs at tab positions of 1 to 3 are inserted into a plurality of trays as below, when an index sheet of tab position 2 is selected, in order to determine a tray out of trays 2 and 5 from which the index sheet is inserted, a group setting is performed.

(1) Tray 1—Tab Position 1 (index sheet A)
(2) Tray 2—Tab Position 2 (index sheet A)
(3) Tray 3—Tab Position 3 (index sheet A)
(4) Tray 4—Tab Position 1 (index sheet B)
(5) Tray 5—Tab Position 2 (index sheet B)
(6) Tray 6—Tab Position 3 (index sheet B)

In a group setting screen 1440, numeric keys 1441 that are used for designating and inputting a group are displayed. A numeric value that is input by pressing the numeric keys 1441 is displayed in the group inputting and displaying field 1442.

On the right side of the numeric keys 1441, a no-designation button 1443 is displayed. When the no-designation button 1443 is pressed, no group designation is set.

When a numeric value of the group number is input, and an OK button 1444 that is located on the lower side of the screen is pressed, the input numeric value becomes a group number. Referring back to the screen illustrated in FIG. 4, the input numeric value is displayed in the group setting displaying field 1416*a*. When the no designation is set, "no designation" is displayed in the group setting displaying field 1416*a*.

When a cancel button 1445 that is located on the lower side of the group setting screen 1440 is pressed, the input numeric value or no designation is cancelled, a numeric value or "no designation" displayed in the group setting displaying field 1442 is removed, and an input of a new numeric value or a setting of the no designation can be made.

Hereinafter, an automatic inserting mode of the index sheet that is performed by the image control CPU 113 will be described. The automatic inserting mode may be set by the initial setting, or a user may select the automatic inserting mode from the automatic inserting mode and a manual index sheet inserting mode on a mechanical setting screen or the like. Furthermore, the automatic inserting mode includes an automatic index sheet inserting mode and a designated tab automatic inserting mode.

Figure 9:
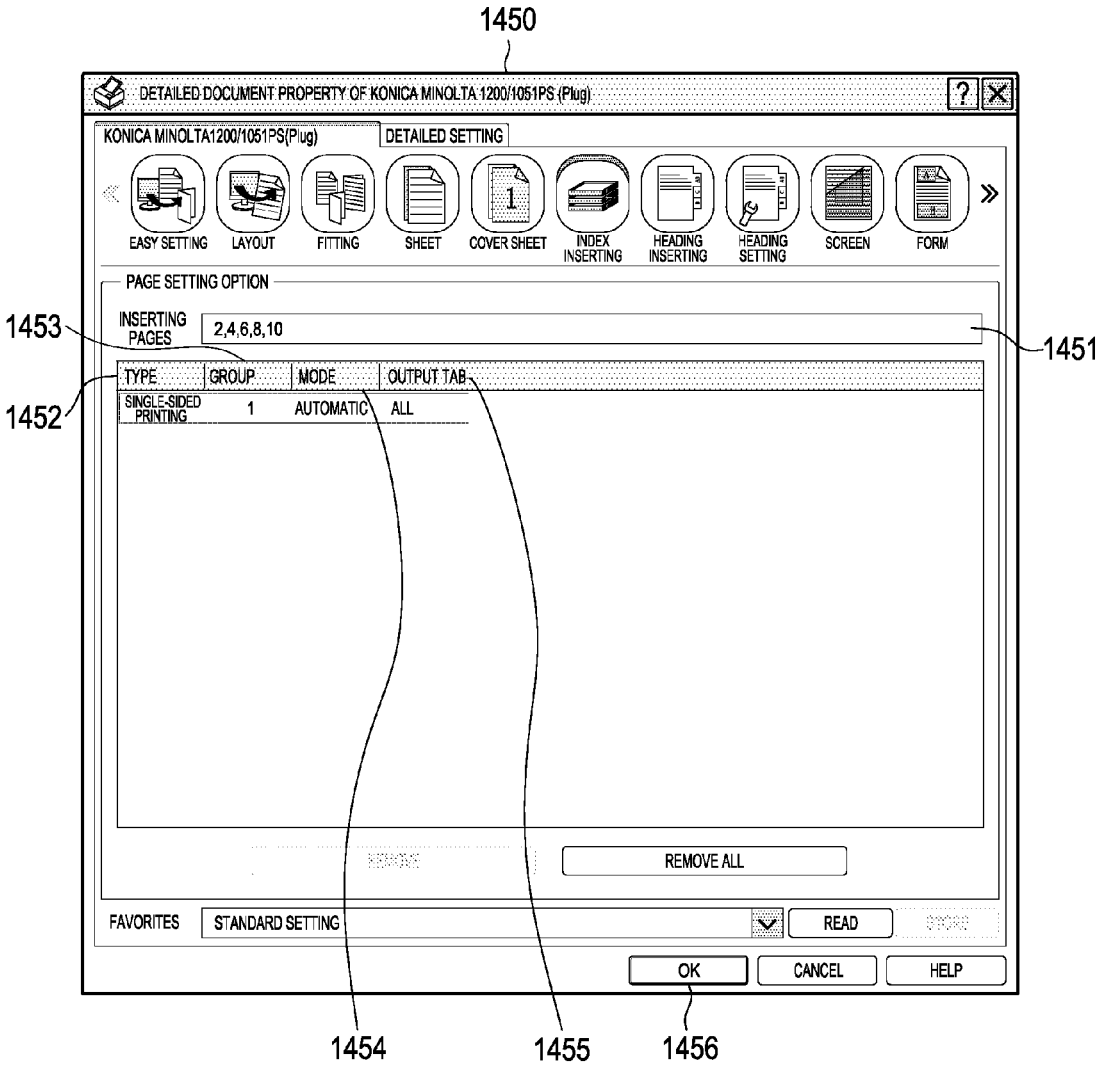
FIG. 9 is a diagram that illustrates a detailed setting screen of a job in an automatic index sheet inserting mode of the image forming apparatus according to the embodiment of the present invention.

FIG. 9 illustrates a detailed setting screen 1450 of a job in which the automatic index sheet inserting mode is set. The detailed setting of a job is made on a printer driver.

By using the printer driver, the index sheet inserting mode is set to "automatic", the output tab is set to "all", and the group is set to group "1". Such a setting is stored in a storage unit such as the non-volatile memory 115 or the HDD 127.

In an inserting page field 1451, pages 2, 4, 6, 8, and 10 are displayed for which an index sheet is inserted, and the pages can be input or changed by a user.

The type is selected from among "single-sided printing", "double-sided printing", and "white sheet", and "single-sided printing" is set in a type field 1452 represented in the figure.

In a group field 1453, the group number of "1" that has been set is displayed.

In a mode field 1454, the "automatic" that has been set is displayed. Namely, the automatic index sheet inserting mode is effective. The mode can be selected from "automatic" and "manual". In the "automatic" mode, a tray in which an index sheet having a tab designated in the output tab field is housed is automatically selected. On the other hand, in the "manual" mode, an index sheet is inserted from a tray that is selected by a user.

In this example, the output tabs are set to "all", and the automatic index sheet inserting mode is set in which the tab position is not designated.

In an output tab field 1455, the "all" that has been set is displayed.

The output tab is selected from "all" and "designation". In the case of "all", all index sheets included in the group are targets of insertion. In the case of "designation", only an index sheet that has a tab located at a designated tab position is a target of insertion.

By pressing an OK button 1456 located on the lower side of the screen, the set content is finalized.

Figure 10:
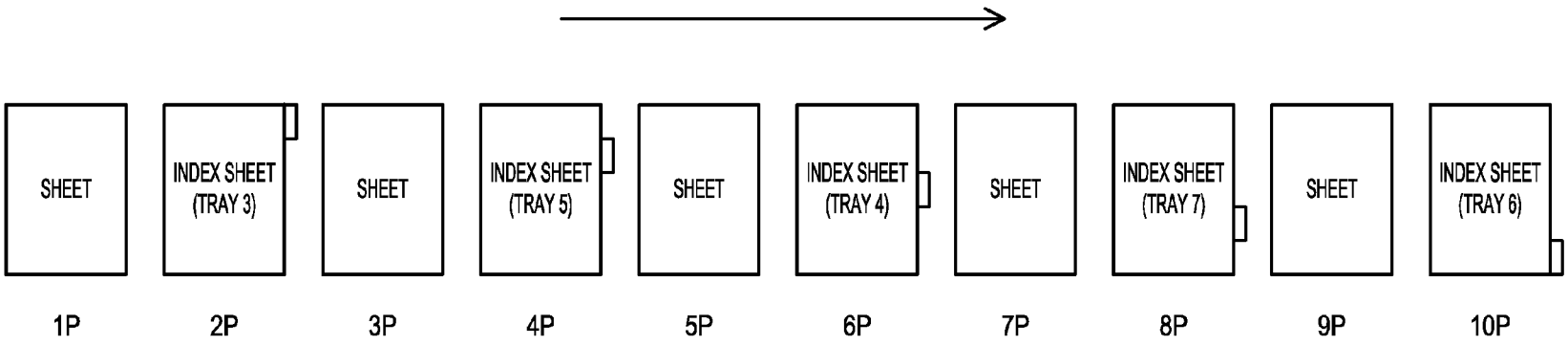
FIG. 10 is a diagram that illustrates an example of insertion of index sheets according to the automatic index sheet inserting mode of the image forming apparatus according to the embodiment of the present invention.

An example of insertion of index sheets based on the above-described setting will be described with reference to FIG. 10. It is assumed that the following settings relating to the index sheets are made for the sheet feeding trays.

Tray 3 (Index Sheet, Number of Indexes: 5, Tab Position: 1, Group 1)

Tray 4 (Index Sheet, Number of Indexes: 5, Tab Position: 3, Group 1)

Tray 5 (Index Sheet, Number of Indexes: 5, Tab Position: 2, Group 1)

Tray 6 (Index Sheet, Number of Indexes: 5, Tab Position: 5, Group 1)

Tray 7 (Index Sheet, Number of Indexes: 5, Tab Position: 4, Group 1)

In addition, in a detailed setting of a job, as described above, a setting is made in which single-sided printing index sheets of Group 1 are automatically inserted to the 2nd, 4th, 6th, 8th, and 10th pages.

In the above-described setting, when it is the turn of each page at which an index sheet is inserted, a sheet feeding tray is automatically selected, and each index sheet is inserted between sheets for which images are formed in order of the tab position.

Figure 11:
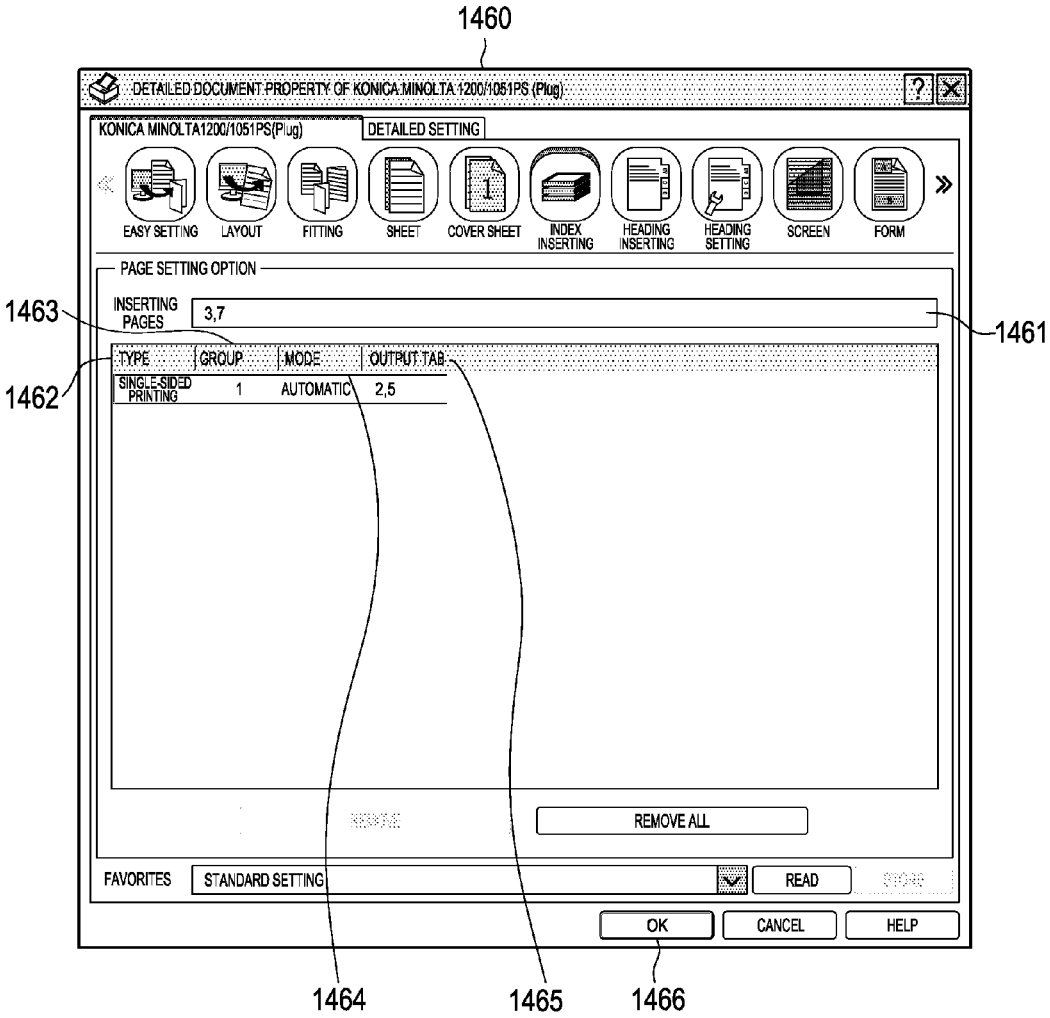
FIG. 11 is a diagram that illustrates a detailed setting screen of a job in a automatic inserting mode by the designated tab position of the image forming apparatus according to the embodiment of the present invention.

FIG. 11 illustrates a detailed setting screen 1460 of a job for which the designated tab automatic inserting mode is set.

The index sheet inserting mode is set to "automatic", the tab positions of output tabs are set to "2 and 5", and the group is set to Group 1 by using the printer driver. Such a setting is stored in the non-volatile memory 115, the HDD 127, or the like.

In an insertion page field 1461, pages (3 and 7 pages) for which index sheets are inserted are displayed, and the pages can be input or changed by a user.

The type is selected from among "single-sided printing", "double-sided printing", and "white sheet". In a type field 1462 illustrated in the figure, "single-sided printing" is set.

In a group field 1463, a group number of "1" that has been set is displayed.

In a mode field 1464, the "automatic" that has been set is displayed. The mode can be selected from between "automatic" and "manual". In this example, the output tabs are designated to specific tab positions, and the designated tab automatic inserting mode is set.

In an output tab field 1465, "2 and 5" that have been set are displayed.

By pressing an OK button 1466 that is located on the lower side of the screen, the set content is finalized.

Figure 12:
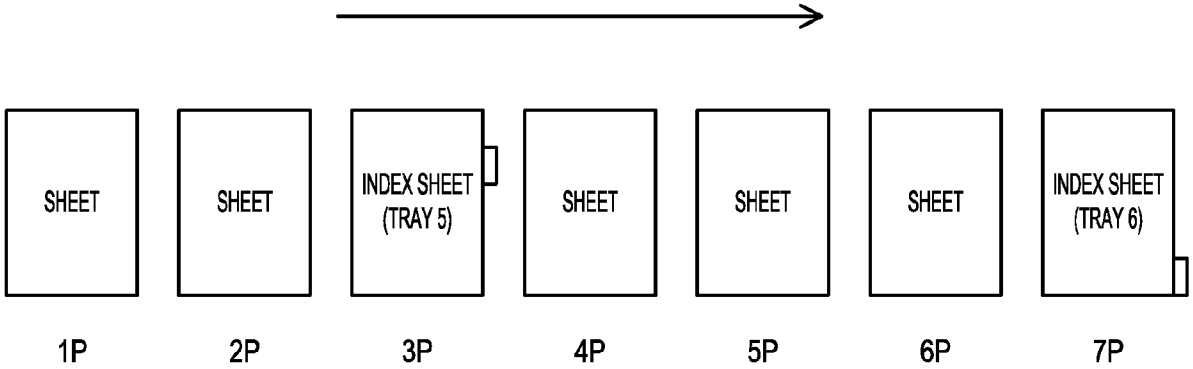
FIG. 12 is a diagram that illustrates an example of insertion of index sheets according to the automatic inserting mode by the designated tab position of the image forming apparatus according to the embodiment of the present invention.

An example of insertion of index sheets based on the above-described setting will be described with reference to FIG. 12. It is assumed that the following settings relating to the index sheets are made for the sheet feeding trays.

Tray 3 (Index Sheet, Number of Indexes: 5, Tab Position: 1, Group 1)

Tray 4 (Index Sheet, Number of Indexes: 5, Tab Position: 3, Group 1)

Tray 5 (Index Sheet, Number of Indexes: 5, Tab Position: 2, Group 1)

Tray 6 (Index Sheet, Number of Indexes: 5, Tab Position: 5, Group 1)

Tray 7 (Index Sheet, Number of Indexes: 5, Tab Position: 4, Group 1)

In addition, in a detailed setting of a job, as described above, index sheets having tab positions of 2 and 5 are set so as to be automatically inserted for the 3rd and 7th pages.

In the above-described setting, when it is the turn of each page at which an index sheet is inserted, a sheet feeding tray in which the index sheet having a tab at a predetermined position is housed is automatically selected, and each index sheet is inserted between sheets for which images are formed. Accordingly, regardless of the order of the tab positions, index sheets having desired tab positions can be inserted.

Figure 13:
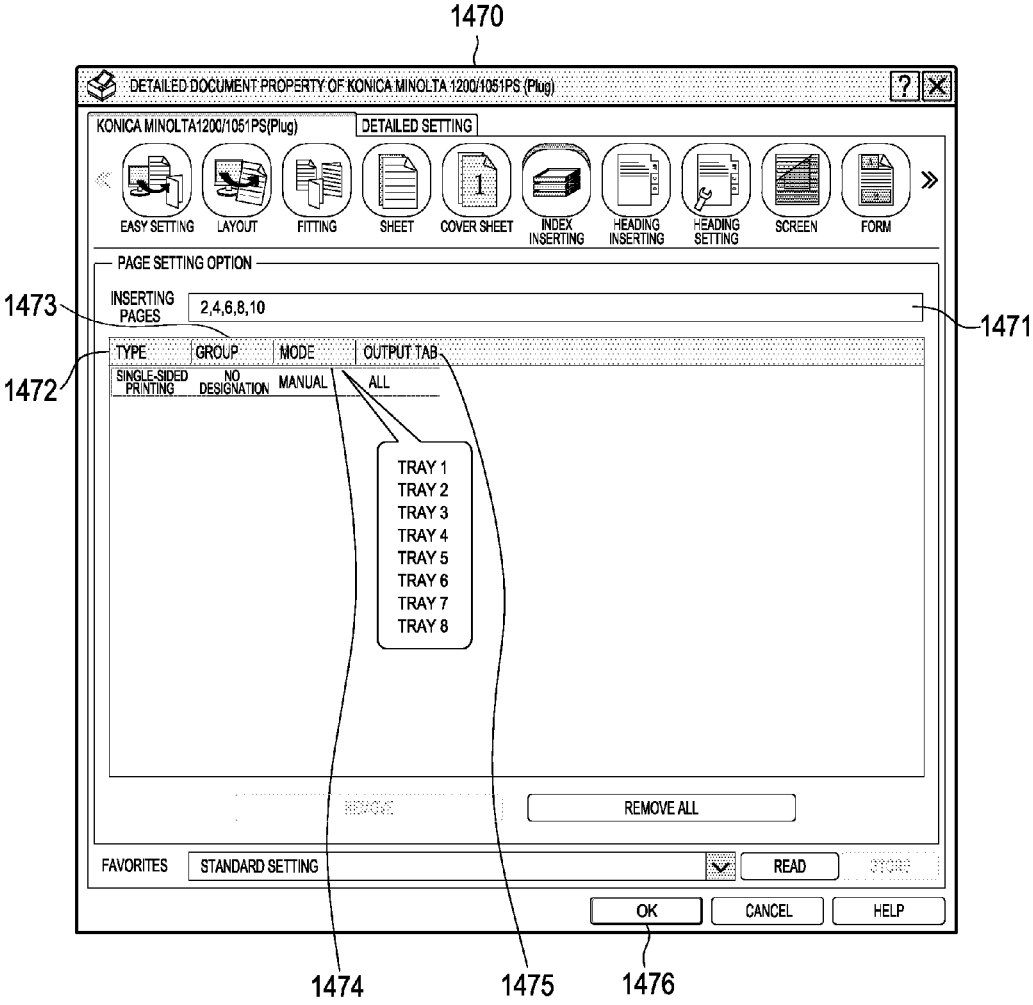
FIG. 13 is a diagram that illustrates a detailed setting screen of a job in a manual index inserting mode of the image forming apparatus according to the embodiment of the present invention.

Next, FIG. 13 illustrates a detailed setting screen 1470 of a job for which the manual index sheet inserting mode is set.

By using the printer driver, the index sheet inserting mode is set to "manual", the tab positions of output tabs are set to "all", and the group is set to "no designation". Such a setting is stored in the non-volatile memory 115, the HDD 127, or the like.

In an inserting page field 1471, pages 2, 4, 6, 8, and 10 are displayed for which an index sheet is inserted, and the pages can be input or changed by a user.

The type is selected from among "single-sided printing", "double-sided printing", and "white sheet", and "single-sided printing" is set in a type field 1472 represented in the figure.

In a group field 1473, "no designation" is displayed. When the manual index sheet inserting mode is set, the group is automatically set to "no designation".

In a mode field 1474, the "manual" that has been set is displayed. Namely, the manual index sheet inserting mode is effective. When the "manual" is selected, selection trays are displayed in a pull-down manner. Then, a sheet feeding tray is designated from among the displayed trays.

In an output tab field 1475, "all" that has been set is displayed.

By pressing an OK button 1476 located on the lower side of the screen, the set content is finalized.

In the manual index sheet inserting mode, for each one of pages 2, 4, 6, 8, and 10 to be inserted, an index sheet is sequentially fed from one sheet feeding tray that is designated. Accordingly, in the designated sheet feeding tray, a bundle of index sheets that are arranged in the insertion order is housed.

FIG. 14 illustrates the structure of setting data that is used in the index sheet inserting mode.

The setting data is formed by 1. Group Designation Setting, 2. Setting Number of Indexes, 3. Tab Positions, 4. Number of Used Trays, 5. Use Order Tray Information, and 6. Insertion Counter.

1. The group designation, in this example, is no designation or is any one of Groups 1 to 5.
2. The setting of the number of indexes, in this example, is any one of 0 to 10.
3. The tab position setting, in this example, is a bundle or any one of tab positions 1 to 10.
4. The number of used trays, in this example, is any one of 1 to 8.
5. The use order tray information, in this example, is the order in which trays 1 to 8 are used. The tray numbers of sheet feeding trays are stored in the order of the use.
6. The insertion counter, in this example, is a numeric value representing a tray that is currently used. For example, a case where the insertion counter is "0" represents an insertion tray 1 of the use order tray information.

The above-described data may be used as index sheet inserting information.

Figure 15:
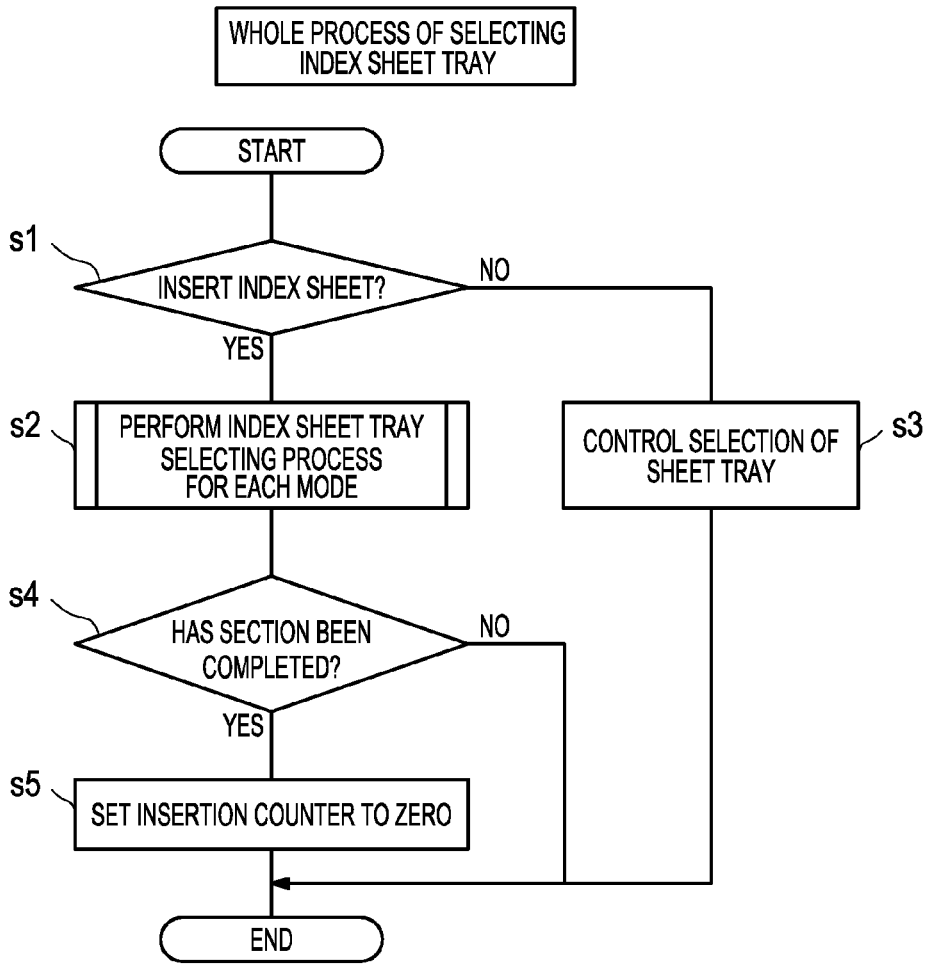
FIG. 15 is a flowchart that illustrates the sequence of a process of selecting an index sheet feeding tray in the image forming apparatus according to the embodiment of the present invention.

Next, the sequence of the whole process of selecting a tray from which an index sheet is inserted will be described with reference to a flowchart illustrated in FIG. 15. In this embodiment, the process illustrated in FIG. 15 is performed by the image control CPU 113.

The process is started by executing a job, and it is determined whether or not the page is a page at which an index sheet is inserted in Step s1. The page at which the index sheet is inserted is set on the detailed setting screen of the job, and it can be determined whether or not the page corresponds to an insertion page.

In a case where the page is not a page at which an index sheet is inserted (NO in Step s1), control is performed so as to select a sheet tray in Step s3, and the process of the page ends.

On the other hand, in a case where the page is a page at which an index sheet is inserted (YES in Step s1), an index sheet tray selecting process for each mode to be described later is performed in Step s2. Thereafter, it is determined whether or not a section ends at the page in Step s4. In a case where the section ends (YES in Step s4), the insertion counter is set to zero, and the process of the page ends. On the other hand, in a case where the section does not end (NO in Step s4), the process of the page ends.

By performing the above-described process for each page, the insertion of index sheets can be controlled in a job.

Figure 16:
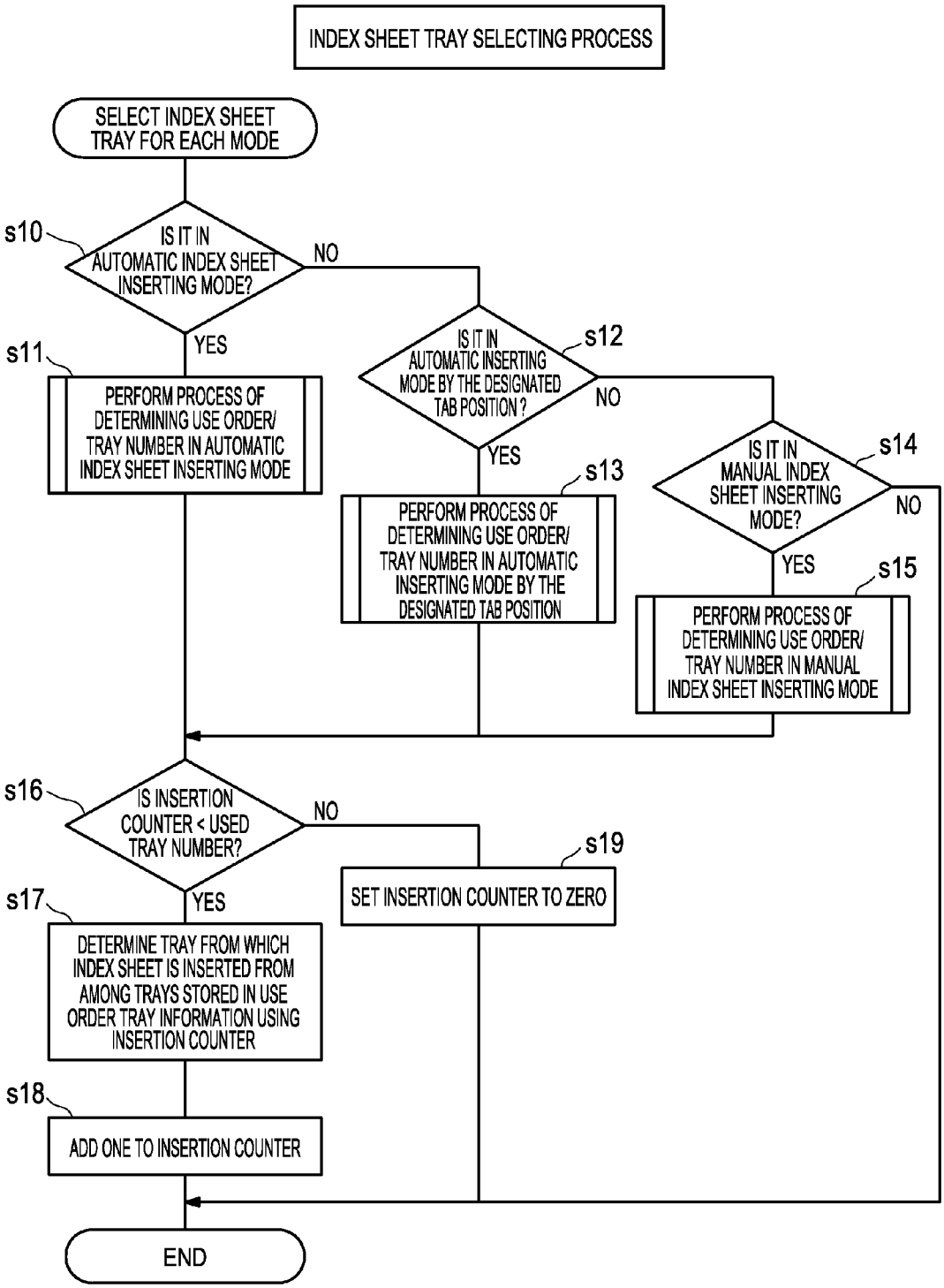
FIG. 16 is a flowchart that illustrates the sequence of a process of selecting an index sheet tray for each mode in the image forming apparatus according to the embodiment of the present invention.

Next, the index sheet tray selecting process (Step s2 illustrated in FIG. 15) for each mode will be described in detail with reference to a flowchart illustrated in FIG. 16.

In the process, first, it is determined whether or not the current mode is the automatic index sheet inserting mode in Step s10.

In a case where the current mode is the automatic index sheet inserting mode (YES in Step s10), a process of determining the use order of trays and the number of used trays in the automatic index sheet inserting mode, which will be described later, is performed in Step s11, and the process proceeds to Step s16.

In a case where the current mode is not the automatic index sheet inserting mode (NO in Step s10), it is determined whether or not the current mode is the designated tab automatic inserting mode in Step s12. In a case where the current mode is the designated tab automatic inserting mode (YES in Step s12), a process of determining the tray use order and the number of used trays in the designated tab inserting mode, which will be described later, is performed in Step s13, and the process proceeds to Step s16.

In a case where the current mode is not the designated tab automatic inserting mode (NO in Step s12), it is determined whether or not the current mode is the manual index sheet inserting mode in Step s14. In a case where the current mode is the manual index sheet inserting mode (YES in Step s14), a process of determining the tray use order and the number of used trays in the manual index sheet inserting mode, which will be described later, is performed in Step s15, and the process proceeds to Step s16. On the other hand, in a case where the current mode is not the manual index sheet inserting mode (NO in Step s14), the process ends without any additional process.

In Step s16, it is determined whether or not the insertion counter is less than the number of used trays. In a case where the insertion counter is less than the number of used trays (YES in Step s16), a tray from which an index sheet is inserted is determined from among the trays stored in the use order tray information based on the insertion counter in Step s17, one is added to the insertion counter in Step s18, and the process ends. On the other hand, in a case where the insertion counter is the number of used trays or more (NO in Step s16), the insertion counter is set to zero in Step s19, and the process ends.

Figure 17:
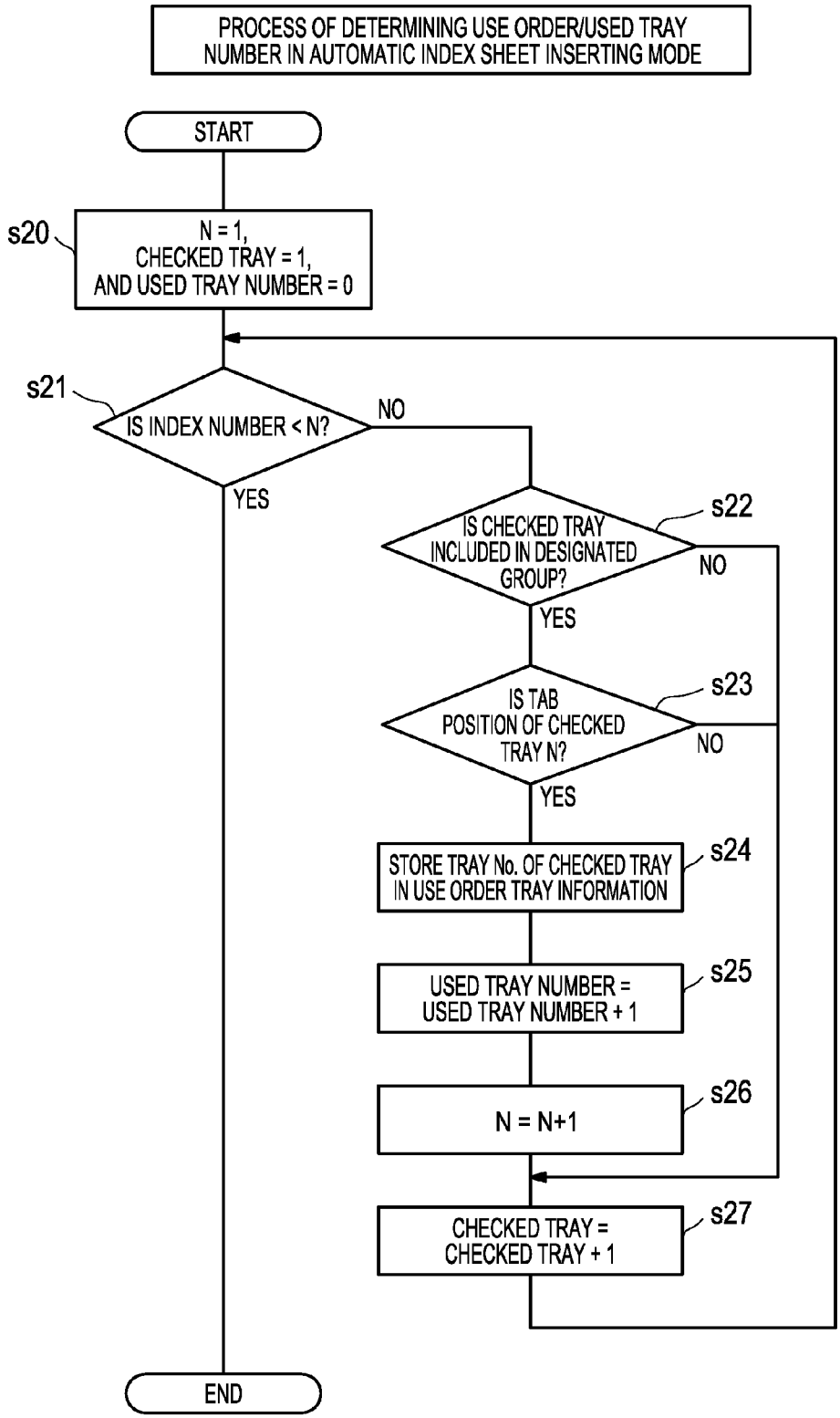
FIG. 17 is a flowchart that illustrates the sequence of a process of determining the order of used trays and the number of the used trays in the automatic index sheet inserting mode of the image forming apparatus according to an embodiment of the present invention.

Next, the sequence of the process (Step s11 illustrated in FIG. 16) of determining the tray use order and the number of used trays in the automatic index sheet inserting mode will be described with reference to a flowchart illustrated in FIG. 17.

In this sequence, first, N=1 is set, checked tray=1 is set, and the number of used trays=0 is set in Step s20. Here, N is a variable relating to the number of indexes.

Thereafter, it is determined whether or not the number of indexes is less than N in Step s21. In a case where the number of indexes is less than N (YES in Step s21), the process ends.

On the other hand, in a case where the number of indexes is N or more (NO in Step s21), it is determined whether or not the checked tray belongs to the designated group in Step s22. In a case where there is no designated group, "YES" is determined.

In a case where the checked tray does not belong to the designated group (NO in Step s22), one is added to the checked tray in Step s27, and the process is returned to Step s21.

On the other hand, in a case where the checked tray belongs to the designated group (YES in Step s22), it is determined whether or not the tab position of the checked tray is N in Step s23. In a case where the tab position of the checked tray is not N (NO in Step s23), the process proceeds to Step s27.

On the other hand, in a case where the tab position of the checked tray is N (YES in Step s23), the tray No. of the checked tray is stored in the use order tray information in Step s24. Thereafter, one is added to the number of used trays in Step s25, and one is added to N in Step s26. Thereafter, one is added to the checked tray in Step s27, and the process is returned to Step s21.

The above-described sequence is repeated, and, when the number of indexes is less N (YES in Step s21), as described above, the process ends.

Figure 18:
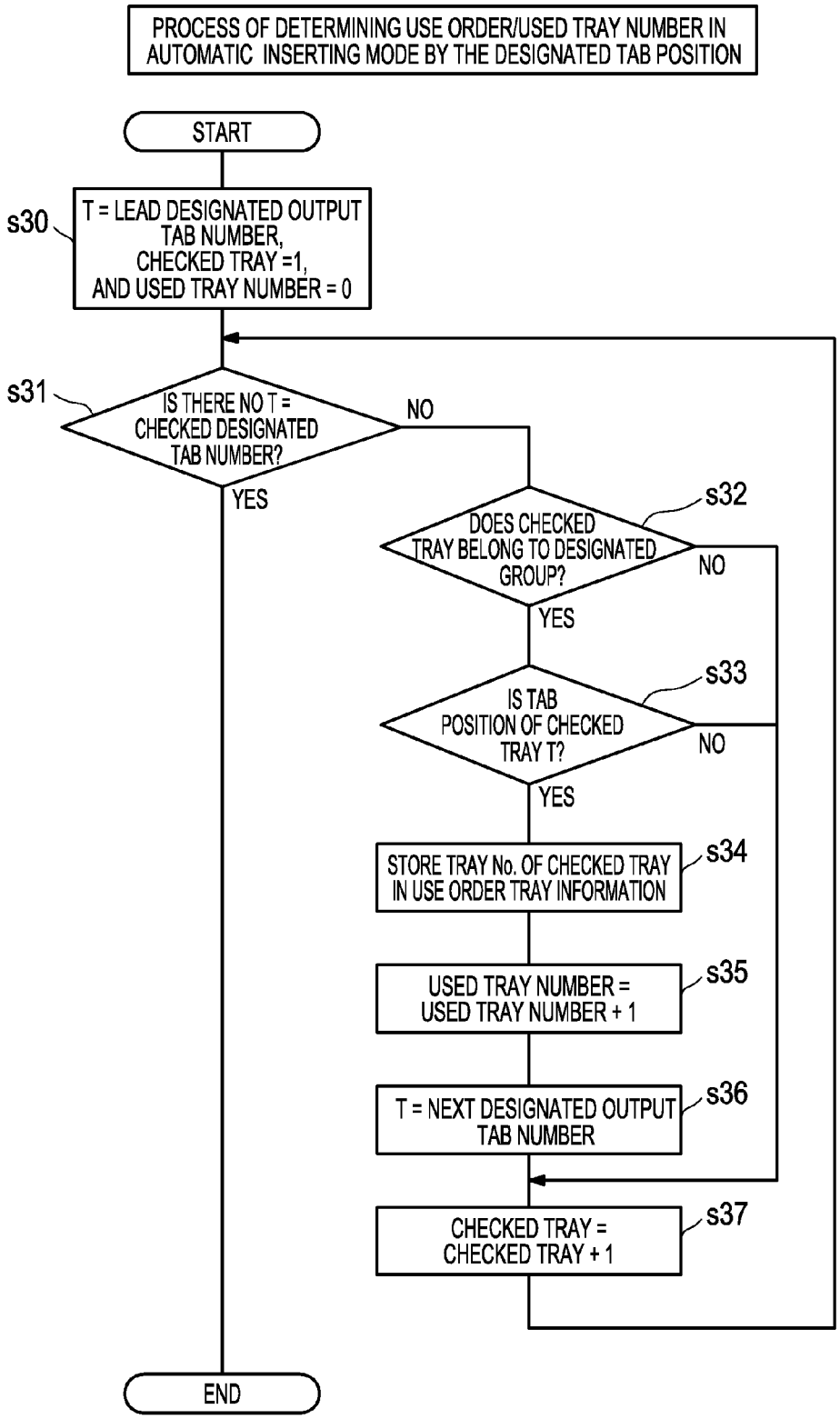
FIG. 18 is a flowchart that illustrates the sequence of a process of determining the order of used trays and the number of the used trays in a designated-tab automatic inserting mode of the image forming apparatus according to the embodiment of the present invention.

Next, the sequence of the process of determining the tray use order and the number of used trays in the designated tab automatic inserting mode will be described with reference to a flowchart illustrated in FIG. 18.

First, T=a lead designated output tab number, the checked tray=1, and the number of used trays=0 are set in Step s30. The lead designated output tab number is a number that represents the tab position of an index sheet that is first output out of numbers representing tab positions set as output tabs on the screen illustrated in FIG. 11. Thereafter, it is determined whether or not T=no checked designated tab number in Step s31. In a case where there is no designated tab number (YES in Step s31), the process ends. On the other hand, in a case where there is a designated tab (NO in Step s31), it is determined whether or not the checked tray belongs to the designated group in Step s32. In the case of no designated group, "YES" is determined.

In a case where the checked tray does not belong to the designated group (NO in Step s32), the process proceeds to Step s37, one is added to the checked tray, and the process is returned to Step s31.

On the other hand, in a case where the checked tray belongs to the designated group (YES in Step s32), it is determined whether or not the tab position set in the checked tray is T in Step s33. In a case where the tab position set in the checked tray is not T (NO in Step s33), the process proceeds to Step s37. In a case where the tab position set in the checked tray is T (YES in Step s33), the tray No. of the checked tray is stored in the use order tray information in Step s34. Thereafter, one is added to the number of used trays in Step s35, then, T is set as the next designated output tab number in Step s36, one is added to the checked tray in Step s37, and the process is returned to Step s31.

The above-described sequence is repeated, and, as described above, when T=no checked designated tab number (YES in Step s31), the process ends.

Figure 19:
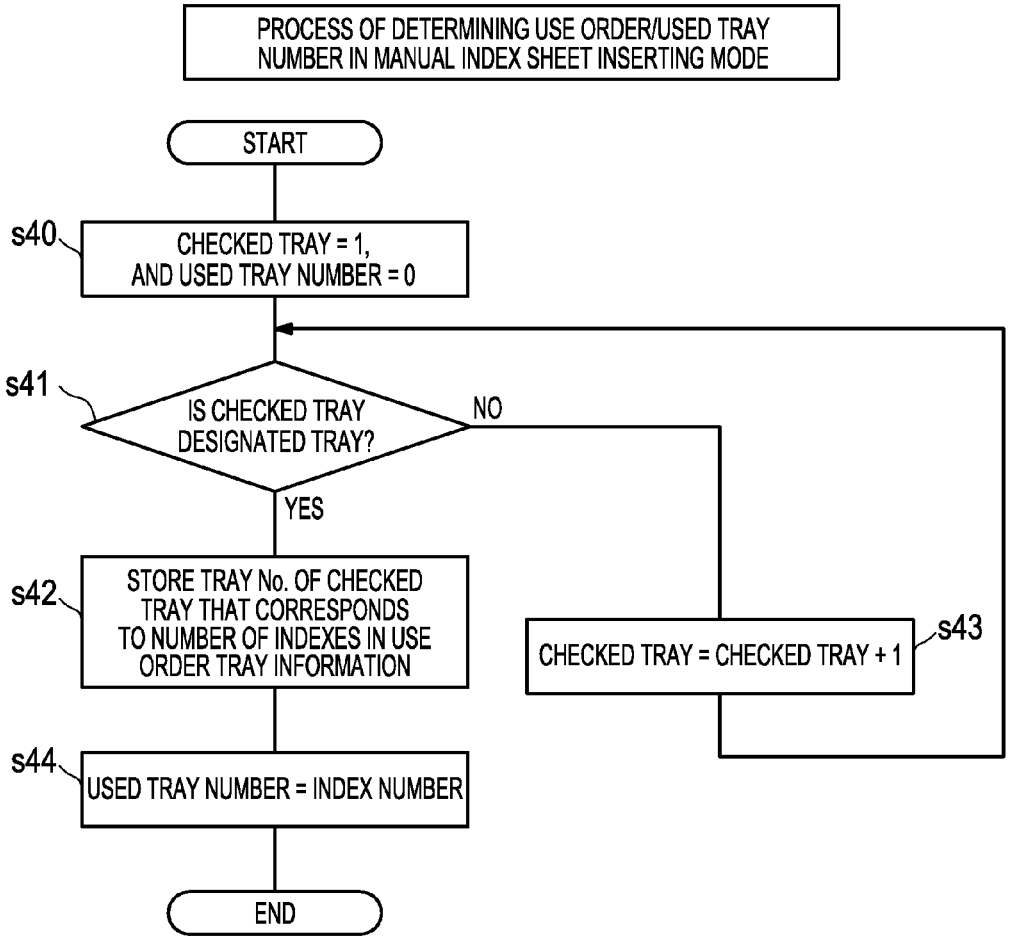
FIG. 19 is a flowchart that illustrates the sequence of a process of determining the order of used trays and the number of the used trays in the manual index sheet inserting mode of the image forming apparatus according to the embodiment of the present invention.

Next, the sequence of the process of determining the tray use order and the number of used trays in the manual index sheet inserting mode will be described with reference to a flowchart illustrated in FIG. 19.

First, checked tray=1 and the number of used trays=0 are set in Step s40, and it is determined whether or not the checked tray is the tray that is designated on the screen illustrated in FIG. 13 in Step s41. In a case where the checked tray is the designated tray (YES in Step s41), the tray Nos. of the checked trays corresponding to the number of indexes is stored in the use order tray information in Step s42. All the tray Nos. are the same. Thereafter, the number of used trays is set to the index number in Step s44, and the process ends.

On the other hand, in a case where the checked tray is not the designated tray (NO in Step s41), one is added to the checked tray in Step s43, and the process is returned to Step s41.

As above, while the present invention has been described based on the embodiment described above, the present invention is not limited to the contents of the above-described embodiment and can be appropriately changed within the scope of the present invention.

For example, in the above-described embodiment, the setting of pages at which index sheets are inserted has been described to be made by pressing various buttons on the screen displayed on the operating unit 140. However, such a setting may be made in an external terminal or the like that is connected to the main body 100. In such a case, the setting information is input to the LAN IF 165 together with the image information.

In addition, in the above-described embodiment, pages at which index sheets are inserted are set as positions at which the index sheets are inserted. However, for example, a page prior to each page at which an index sheet is inserted may be set as the position at which the index sheet is inserted. Alternatively, a page prior to each page at which an index sheet is inserted and a page right after the each page may be set.

What is claimed is:

1. An image forming apparatus comprising:

a plurality of trays each of which stores an index sheet provided with a tab at a same predetermined position of the index sheet, respectively;

a setting section to set first information concerning the index sheet stored in the tray for each of the plurality of trays;

a receiving section to receive second information concerning an insertion of the index sheet in a job;

a controller to control an execution of the job and an operation of feeding the index sheet;

wherein:

the first information includes a tab position of the index sheet, an index number which shows a number of types of the tab position of the index sheet, and a group of a plurality of the index sheets concerning the index sheets stored in each of the trays;

the second information includes an inserting position of inserting the index sheet, the group, and the tab position used in the job based on the index number when the index sheet is inserted; and the controller automatically selects the tray which stores the index sheet provided with the tab according to the tab position based on the index number and the group of the index sheet in the execution of the job based on the first information and the second information.

2. The image forming apparatus of claim 1, wherein the controller enables carrying out a manual inserting mode which enables selection of the tray for inserting the index sheet manually.

3. The image forming apparatus of claim 1, further comprising an input section which is operable by a user and controlled by the controller.

4. The image forming apparatus of claim 3, wherein the second information is set by the input section.

5. The image forming apparatus of claim 3, wherein the setting section sets the first information based on information inputted by the input section.

6. The image forming apparatus of claim 1, further comprising a memory controlled by the controller, wherein the controller writes the first information on the memory.

7. The image forming apparatus of claim 1, the first information includes an information indicating that a series of the index sheets are stored in the tray.

* * * * *